United States Patent [19]

Wightman et al.

[11] Patent Number: 4,917,421

[45] Date of Patent: Apr. 17, 1990

[54] DETACHABLE FASTENER FOR ELECTRICAL ENCLOSURES

[75] Inventors: David B. Wightman, White Bear Lake; Steven J. Hammond, Coon Rapid; Robert A. Knoss, St. Francis, all of Minn.

[73] Assignee: Federal-Hoffman, Inc., Anoka, Minn.

[21] Appl. No.: 265,696

[22] Filed: Nov. 1, 1988

[51] Int. Cl.[4] ..... E05C 5/02

[52] U.S. Cl. ..... 292/247; 292/DIG. 53

[58] Field of Search ..... 292/247, 258, 113, 257, 292/246, DIG. 53, DIG. 60

[56] References Cited

U.S. PATENT DOCUMENTS

| | | | |
|---|---|---|---|
| D. 292,171 | 10/1987 | Berg | D8/331 |
| 2,485,012 | 10/1949 | Palmer et al. | 292/228 |
| 3,129,025 | 4/1964 | Krueger | 292/97 |
| 3,146,011 | 8/1964 | Seevers | 292/247 |
| 3,193,314 | 7/1965 | Johnson | 292/113 |
| 3,490,805 | 1/1970 | De Pierro et al. | 292/258 |
| 3,584,912 | 6/1971 | Leger | 296/117 |
| 3,730,576 | 5/1973 | Schurman | 292/246 |
| 4,127,305 | 11/1978 | Nielsen | 292/113 |
| 4,342,136 | 8/1982 | Okobe et al. | 292/113 X |
| 4,512,598 | 4/1985 | Coller | 292/DIG. 53 X |
| 4,631,937 | 12/1986 | Debus et al. | 70/207 |
| 4,667,367 | 5/1987 | White et al. | 16/258 |
| 4,779,828 | 10/1988 | Munch | 24/339 |

*Primary Examiner*—Richard E. Moore

*Attorney, Agent, or Firm*—Schroeder & Siegfried

[57] ABSTRACT

A readily detachable fastener for mounting upon an enclosure, the fastener having a base member with channeled edge portions designed to slidably engage the enclosure upon which it is mounted. A connector pin extends outwardly from the base member, and is designed to releasably lock into a pin receiving hole of the enclosure such that the detachable fastener may be attached or removed from the enclosure, as desired. A latch is pivotally connected to the base member, and carries a bail which catches on the cover of the enclosure when the latch is pivoted to an open position. The latch may then be pivoted to a closed position, thereby tightly securing the cover to the enclosure. The base member and latch are constructed with openings therethrough so as to accommodate locking the same together with a conventional lock.

14 Claims, 2 Drawing Sheets

DETACHABLE FASTENER FOR ELECTRICAL ENCLOSURES

BACKGROUND OF THE INVENTION

In general, enclosures have for years served many storage purposes, ranging from long-term or permanent storage which requires little or no access therewithin to short-term storage or storage where frequent access within the container is required. For example, one particular situation involves the use of electrical boxes and wireways, etc. Quite often an enclosure for electrical wiring may need little to no maintenance, and may even be sealed against outside air from entering the enclosure, thereby being of the long-term permanent storage type enclosure. On the other hand, other electrical boxes frequently have timers or clocks installed therein, and require frequent maintenance and inspections, thereby putting them in the class of enclosures which require frequent access therewithin.

Enclosures which require frequent access are often accompanied with some type of conventional quick-release latch or fastener so that the user may readily open the enclosure to inspect or maintain the contents therewithin. Long-term more permanent type enclosures often have the covers or doors thereto more permanently secured to the containers by means of screws which are not readily or easily opened. In fact, non-standard bolt head configurations are often used when a particular manufacturer is interested in keeping unauthorized individuals from accessing the interior of an enclosure.

There are also occasions where the contents of a more permanent type enclosure are modified so as to require more frequent access for inspection or maintenance purposes. Moreover, there are also times when enclosures containing items which need frequent inspection may be modified so that they no longer require such timely inspections. In fact, it is conceivable with today's technology that the contents within enclosures that require frequent maintenance may be replaced with newer technology which requires little to no maintenance. Thus, a quick release latch is no longer needed for such a box, and may be undesirable in view of the new contents which are to be enclosed therewithin.

With a conventional enclosure, the discussion above poses a particularly difficult problem, since a conventional enclosure which is designed to have the cover or door sealed to the enclosure by means of a screw or other more permanent fastener cannot be converted into an enclosure having a quick-release type fastener. Similarly, a conventional enclosure having a quick-release type fastener cannot be readily converted into an enclosure for more permanent storage. In order to convert one enclosure to another, it is necessary to purchase the entire enclosure which suits the needs that are required for a given situation.

Because of the problems posed with converting a conventional enclosure from one type to another, there has been a long felt need for a means of providing an enclosure having the versatility to function in both a longterm more permanent unattended situation, and in the situation where more frequent access to the interior of the enclosure is required. In other words, there is a need for a means for converting one type of enclosure into the other type of enclosure, and vice versa.

We have developed such a means for converting an enclosure designed for more permanent unattended storage into an enclosure where frequent access is readily available, and vice versa. We have found that there is a demand for a detachable fastener which can replace a conventional screw on a more permanent unattended enclosure to provide an enclosure where the interior is readily accessible when desired. Such a latch could be sold as an accessory or as part of the enclosure, thereby giving the purchaser the option of using the enclosure as a more permanent unattended type, or an enclosure which is more frequently opened.

SUMMARY OF THE INVENTION

In general, our invention is related to the field of providing versatile enclosures, such as electrical enclosures, for use and reuse in a variety of different situations. In particular, our invention is related to providing a detachable fastener used for securing the cover or door of an enclosure to the main body of the enclosure. The detachable fastener is generally of the quick-release type for use with enclosures whose interior is accessed on a more regular basis. The primary object of the detachable fastener is to provide an optional fastener that may be sold as an accessory item with such enclosures, and can readily replace the conventional more permanent screws which secure the covers or doors to such enclosures in their closed position.

The detachable fastener which is the subject of our invention has a base member which is constructed such that it will slidably engage a channel portion of the enclosure upon which it is to be carried. The base member also has a connector pin extending outwardly therefrom which is designed to be resilient, and has dimensions such that it will readily interconnect with the existing screw holes in the enclosure, which generally receive screws to secure the cover of the enclosure to the main body of the enclosure in a conventional manner.

Thus, the base member is essentially a detachable unit, in itself, which can be easily connected to the enclosure without the use of tools. The connector pin is constructed with outer locking ribs extending therearound which function to catch and lock within the existing screw hole in the enclosure. The connector pin has a central longitudinal slit which provides its resiliency so that the connector pin may be unlocked and readily released from within the screw hole when desired. By so doing, the detachable base member is then capable of being slidably dismounted from the enclosure itself. In this manner, the detachable base member of the fastener may be mounted or dismounted with relative ease, and without the use of tools, as desired.

The detachable base member also functions as a pivot mount for a latch member which is pivotally connected thereto, and is constructed so as to be moveable between an open position and a closed position, where it lies closely adjacent to the base member. The pivotal latch member carries a catch means or bail which is designed to catch the cover of the enclosure when the latch member is pivoted to its open position. By moving the latch member to its closed position, the bail member will pull the cover of the enclosure tightly against the main body thereof, thereby securing the cover thereto.

In use, the detachable fastener may be sold as an accessory item to a conventional enclosure having screw holes therein which are normally adapted to receive a conventional screw which tightly secures the cover to the main body of the enclosure. When it is desired to convert a conventional enclosure used for more permanent unattended storage to an enclosure which will require more frequent access therein, the conventional screws may be removed and the new detachable fastener may be connected to the enclosure. To do this, the detachable base of the fastener is slidably engaged within a channel formed on the enclosure and positioned in locked engagement, with the connector pin in a releasably locked relationship with the screw hole in the main body of the enclosure. Then, when desired, the cover may be tightly secured to the main body of the enclosure by pivoting the latch member to its open position so that the bail will catch on the cover of the enclosure. By pivoting the latch member to its closed position, the cover is tightly secured to the main body of the enclosure.

Thus, a previously more permanently unattended enclosure can be easily and quickly converted into an enclosure for storage of items which must be frequently inspected or maintained. To convert an enclosure back to a more permanent enclosure, the detachable fastener may be demounted and replaced with conventional screws. The detachable fastener may also be constructed with a means for locking the latch member to the detachable base member so that once the cover is tightly secured to the main body of the enclosure, a conventional lock may be utilized to hold the latch member in its closed position adjacent the base.

As it is the primary object of this invention to provide a means for converting a more permanent unattended enclosure into an enclosure for use with storage items which need more frequent inspection and maintenance, or vice versa, the new detachable fastener has provided us with such capabilities which not only saves a perspective customer money in having to purchase a new enclosure, but also provides a perspective user of such an enclosure with an economical easy-to-apply optional fastener which can be mounted or demounted when desired.

DETAILED DESCRIPTION OF THE INVENTION

Figure 2:
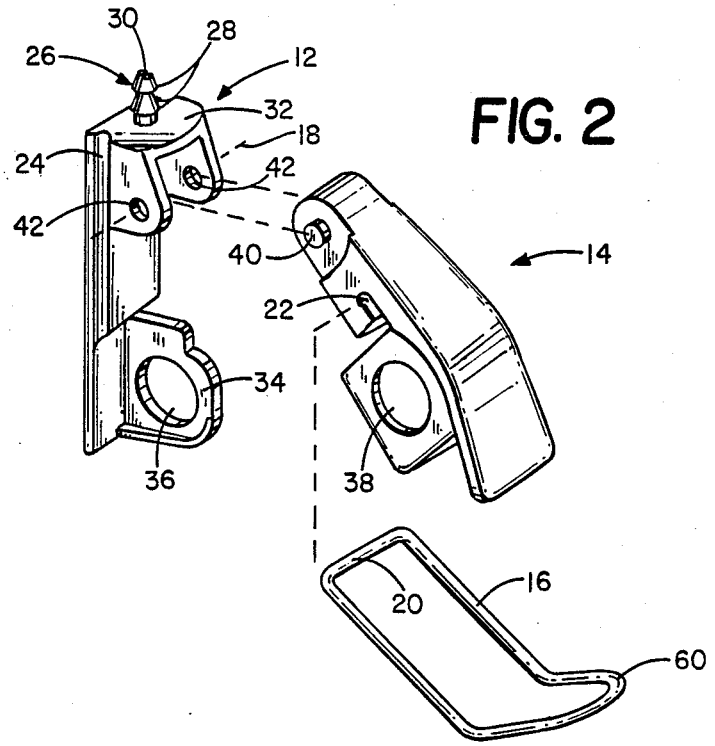
FIG. 2 is an exploded view of our new detachable latch.
Figure 1:
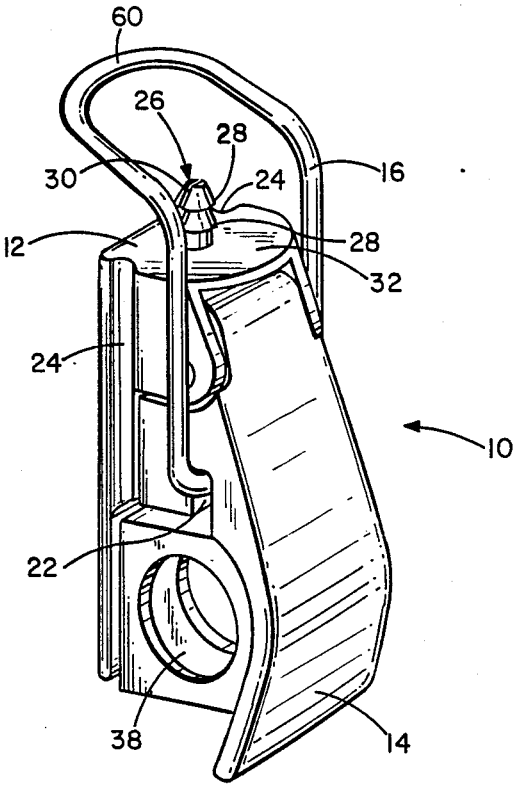
FIG. 1 is a perspective view of our new detachable latch prior to being mounted on an enclosure.

FIG. 1 shows our new detachable fastener 10 prior to being mounted upon an enclosure or the like which requires such a fastener. As best shown in FIG. 2, our new detachable fastener 10 generally includes a base member 12 which functions as a pivot mount for a latch member 14. Latch member 14 carries a bail or catch member 16. In its fully assembled state, our detachable fastener is configured as shown in FIG. 1, where latch member 14 is pivotally mounted on base 12 about axis 18, and bail member 16 has a rearward portion 20 which snaps into groove 22 and is rotatably mounted therein.

Base member 12 has channel portions 24 which extend longitudinally along each transverse side thereof. Channel portions 24 are adapted for slidable interengagement with an enclosure or the like, which will be discussed further below. Base member 12 further includes a connecting or locking member 26 which extends outwardly from the front end thereof. Connecting member 26 has a plurality of locking ribs 28 and a central transverse slit 30 therethrough which extends longitudinally from the front end thereof to a point adjacent the front end 32 of base member 12.

The central transverse slit 30 and the locking ribs 28 provide the detachable fastener with a readily detachable locking feature. The central slit 30 causes the connector pin 26 to be resilient and capable of being compressed to a smaller compass so as to be able to insert the same into a screw hole 62 of a conventional enclosure 46. Upon insertion of the connector pin into the screw hole 62 of an enclosure, the locking ribs 28 interengage with the threads of screw hole 62. The locking ribs 28 lock the connector pin 26 in the screw hole so that the base member cannot be disconnected from the enclosure until the connector pin 26 is compressed further to a point where the outer diameter of the locking ribs 28 is less than inner diameter of the screw hole 62.

Base member 12 also has a flanged portion 34 which extends outwardly toward the pivotal latch member 14. The flange member 34 has an opening 36 extending therethrough which is positioned in cooperative alignment with a pair of openings 38 in each transverse side of the main body of latch member 14. The cooperative alignment between openings 38 and opening 36 allows the user of our detachable fastener to insert a conventional lock (not shown) therethrough to lock latch member 14 in its closed position adjacent to base member 12.

Latch member 14 has pivot pins 40 extending outwardly from each transverse side thereof, and are adapted to be received within apertures 42 of base member 12, respectfully. Pins 40 are constructed to snap into apertures 42, and each pin 40 may have a chamfered front portion to facilitate ease in the mounting thereof. Axis 18 extending through apertures 42 in base member 12 is the pivot axis for latch member 14, where latch member 14 may pivot between its open and closed position.

Figure 3:
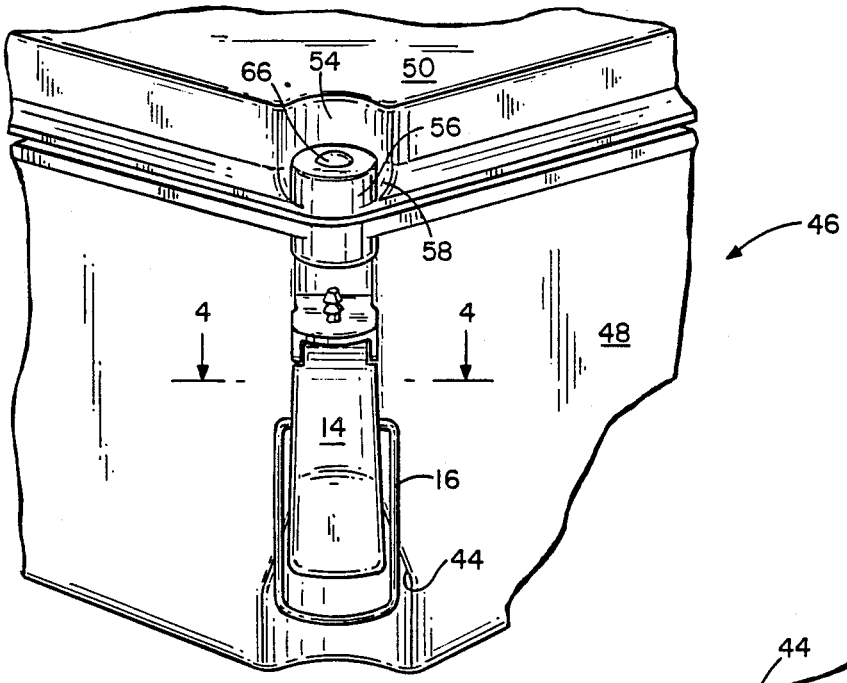
FIG. 3 is a perspective view of an enclosure carrying our new detachable latch in a partially mounted, slidably engaged position.
Figure 4:
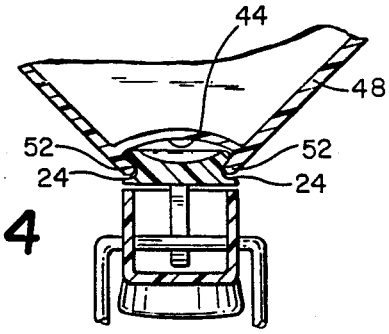
FIG. 4 is a sectional view taken along lines 4—4 in FIG. 3 and shows the slidable interengagement between the base of our new detachable latch and the enclosure carrying the same.

Turning now to FIGS. 3–6, the particular advantages and uses of our new detachable fastener 10 will become evident. FIG. 3 shows our new detachable fastener 10 in a partially mounted position where the detachable fastener 10 is slidably interengaged with a corner channel portion 44 of a conventional enclosure 46 having a main body portion 48 and a cover portion 50. As shown best in FIG. 4, the channeled or grooved portions 24 in the base member 12 of the detachable fastener 10 cooperatively interengage with channel defining portions 52 of the main body 48 of enclosure 46. Such cooperative interengagement between the base member 12 and the enclosure 46 prevents the detachable fastener from being pulled away from the enclosure in a direction normal thereto once the detachable fastener has been mounted thereon.

Each corner of cover 50 for enclosure 46 has a recessed portion 54, and an upwardly extending post 56 which is spaced from recessed portion 54, thereby defining a groove 58 therebetween. As shown best in FIGS. 1 and 5, the bail or catch member 16 has a curved outer end portion 60 which has an inner radius approximating the outer radius of post 56. The outer end portion 60 of bail 16 is designed to extend over post 56 and catch within groove 58 when latch member 14 is lifted to its open position. Upon closing latch 14, as shown in FIG. 6, bail member 16 pulls cover 50 securely into its proper position relative to the main body 48 of enclosure 46.

Post 56 has a central aperture extending downward therethrough (not shown) which allows a conventional screw to extend therethrough and to be threaded into the cooperatively aligned threaded aperture 62 in the corner portion of the main body 48 of enclosure 46. As such, in its conventional use, enclosure 46 is adapted for use with conventional screws. As noted above, our new detachable fastener 10 is designed to be adaptable for use with such conventional enclosures. By removing the conventional screw from the enclosure, the opening extending through post 56 may be plugged with cap 66. With the conventional screw removed, our detachable fastener may be slid into its fully mounted position (as shown in FIG. 5), wherein connector pin 26 extends into threaded aperture 62 and interlocks therewith.

Figure 5:
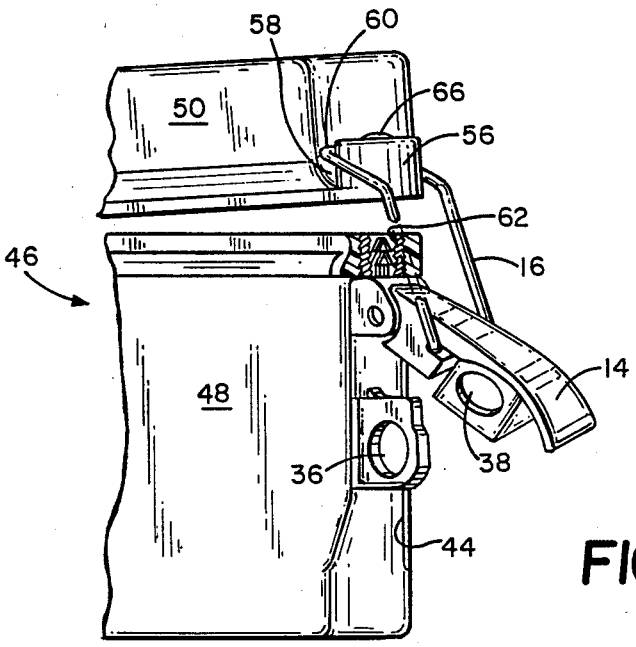
FIG. 5 is a perspective view of our new detachable latch in its fully mounted open position, and further showing a portion of the enclosure broken away to demonstrate the readily detachable locking feature of our new detachable latch.

More specifically, as shown in FIG. 5, our detachable fastener 10 may be slid into a position where connector pin 26 abuts threaded aperture 62. Initially, connector pin 26 has an outer diameter greater than the inner diameter of threaded aperture 62. However, as pressure is exerted upwardly (as shown in FIG. 5) against our detachable fastener 10, threaded aperture 62 will compress the connector pin 26 into a smaller compass so as to allow the same to enter therewithin. Central slit 30 in connector pin 26 gives the same the resilience and required flexibility to be compressed into a small enough compass to be received within threaded aperture 62, without undue pressure being exerted on our detachable fastener 10. Once in place, locking ribs 28 interengage with the threaded portions of threaded aperture 62 to prohibit the detachable fastener from being removed from within the same.

Figure 6:
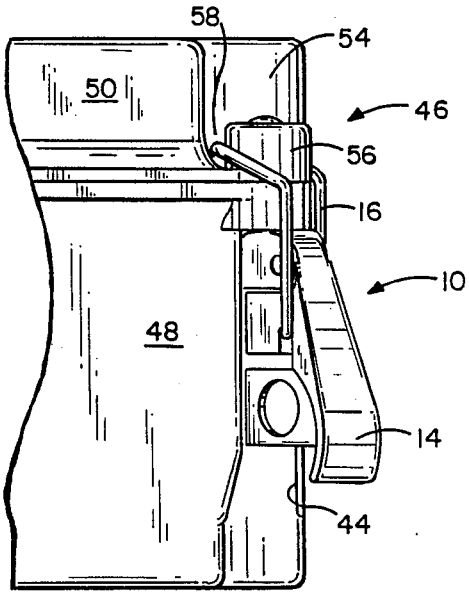
FIG. 6 is a perspective view of our new detachable latch in its fully mounted closed position, showing the bail member of our new detachable latch catching on the cover and securing the same to the enclosure when the latch is closed.

Once bail member 16 is rotated within slot 22 to a position where its curved outer portion 60 catches within groove 58 of cover 50, latch 14 may be pivoted to its closed position, as shown in FIG. 6. By so doing, bail or catch member 16 effectively pulls the cover 50 into tight, secure relation with the main body 48 of closure 46. If desired, the user of our detachable latch 10 may lock enclosure 46 with its cover 50 tightly secured to the main body 48 by inserting a conventional lock through openings 38 of latch member 14 which are in cooperative alignment with opening 36 in flange 34 of base member 12. By so doing, latch member 14 is effectively locked to base member 12 and may not be pivoted to its open position, thereby locking the enclosure.

It can be appreciated from the drawings and disclosure made herein that our detachable latch 10 makes it possible for enclosures of the conventional-type to be converted from a more permanent type storage container to a container which accommodates more frequent access, and vice versa, by interchanging the conventional screw for our new detachable latch 10 when such a change is required. Overall, it provides a means for alternative usage of a conventional enclosure in the most economical manner possible. Our detachable fastener 10 may be sold as an accessory item to a conventional enclosure, thereby providing the user with one versatile enclosure rather than two or more enclosures designed only for one specific purpose.

In considering this invention, it should be remembered that this disclosure is illustrative only, and the scope of the invention should be determined by the appended claims.

What is claimed is:

1. A readily detachable fastener for securing adjacent structures together, at least one of which has a pin receiving hole therein, comprising:

(a) a base pivot member having channeled side portions and being constructed and arranged to detachably engage one of the adjacent structures in a positive readily releasable relationship;

(b) a latch member pivotally mounted to said base pivot member so as to be movable between an open and closed position;

(c) a bail member carried by said latch member, said bail member being constructed so as to catch on the adjacent structure opposite the structure engaged by said base pivot member when said latch is in its open position, and tightly securing the adjacent structures together when said latch member is moved to its closed position; and (d) a resilient connector pin connected to said base pivot member and extending outwardly therefrom, one end of said connector pin being connected to said base pivot member and the other free end of said connector pin having a central slit therein, said connector pin further having locking ribs extending outwardly from the outer surface thereof, and said connector pin being constructed and arranged to releasably interlock with the pin receiving hole in one of the adjacent structures.

2. A readily detachable fastener for securing adjacent structures together, at least one of which has a pin receiving hole therein, comprising:

(a) a base pivot member having channeled side portions and being constructed and arranged to detachably engage one of the adjacent structures in a positive readily releasable relationship;

(b) a latch member pivotally mounted to said base pivot member so as to be movable between an open and closed position;

(c) a bail member carried by said latch member, said bail member being constructed so as to catch on the adjacent structure opposite the structure engaged by said base pivot member when said latch is in its open position, and tightly securing the adjacent structures together when said latch member is moved to its closed position; and (d) said channeled side portions of said base pivot member being constructed and arranged to slidably interengage with portions of the adjacent structure that carries the same.

3. A readily detachable fastener, comprising:

(a) a pair of adjacent structures, at least one of said structures having a channel portion formed therein;

(b) a detachable base member constructed and arranged to slidably engage said channel portion and to releasably interlock with said structure having said channel portion;

(c) a latch member pivotally mounted on said base and constructed to pivot between a closed and open position;

(d) a catch means pivotally connected to said latch member and constructed and arranged for catching on said adjacent structure not carrying said detachable base and securing said adjacent structures together when said latch member is in its closed position; and (e) said detachable base member having a resilient connecting pin attached thereto, said pin having a free end portion which is constructed and arranged to be received in a releasable locking relationship within a pin receiving hole on said structure carrying said base member.

4. The structure defined in claim 3, wherein said pin has a central slit extending from said free end portion a substantial distance toward said base member, and said pin having at least one locking rib extending outwardly from the outer surface thereof to facilitate the locking of said pin within said pin receiving hole on said structure carrying said base member.

5. A readily detachable fastener, comprising:

(a) a pair of adjacent structures, at least one of said structures having a channel portion formed therein;

(b) a detachable base member constructed and arranged to slidably engage said channel portion and to releasable interlock with said structure having said channel portion;

(c) a latch member pivotally mounted on said base and constructed to pivot between a closed and open position;

(d) a catch means pivotally connected to said latch member and constructed and arranged for catching on said adjacent structure not carrying said detachable base and securing said adjacent structures together when said latch member is in its closed position; and (e) said channel portion of said structure carrying said base member having overhanging side lip portions of which interengage with channeled side portions of said base member when said base member slidably engages said channel portion of said structure carrying said base member.

6. The structure defined in claim 5, wherein said catch means is comprised of a bail which is designed to catch on the adjacent structure opposite the structure carrying said base member when said latch means is pivoted to its open position, and said bail being constructed and arranged to pull said adjacent structures tightly together when said latch member is pivoted to its closed position.

7. A readily detachable fastener for securing a pair of adjacent structures together, comprising:

(a) a base pivot member constructed and arranged to detachably and positively engage one of the adjacent structures, and to be readily releasable therefrom;

(b) a latch member pivotally connected to said base pivot member for pivoting between an open and closed position;

(c) a catch means carried by said latch member for catching on the other adjacent structure opposite to the structure engaged by said base pivot member so as to secure the two structures together when said latch means is pivoted to its closed position; and (d) said base pivot member having channeled side portions which facilitates slidable interengagement between said base pivot member and the structure carrying the same.

8. The structure defined in claim 7, including a resilient connector pin attached to said base pivot member and extending outwardly therefrom, said connector pin being constructed and arranged to interengage with the structure carrying said base pivot member in a readily releasable interlocking relationship.

9. The structure defined in claim 8, wherein said connector pin includes a plurality of locking ribs on the outer surface thereof which are constructed and arranged to releasably lock said base pivot member to the structure carrying the same when said connector pin is in interlocking relationship with that structure.

10. The structure defined in claim 7, including a means for locking said latch member in its closed position to said detachable base member so that the adjacent structures may be effectively locked together in tightly secured relation.

11. A readily detachable fastener for securing a pair of adjacent structures together, comprising:

(a) a readily detachably base member, said detachable base member having channeled side portions which are constructed and arranged to slidably interengage with the structure carrying the same, and to interlock therewith in a positive readily releasable relationship so as to prevent said detachable base from being pulled away from the structure to which it is engaging;

(b) a latch member pivotally mounted on said base and constructed to move between an open and closed position; and (c) a catch means connected to said latch member for catching on the other adjacent structure opposite the structure carrying said base so as to secure said structures tightly together when said latch member is moved to its closed position.

12. The structure defined in claim 11, wherein said detachable base member includes a resilient connecting pin having locking ribs extending outwardly therefrom, said connecting pin being constructed to facilitate a releasable interlocking relationship between said base member and the structure carrying the same.

13. The structure defined in claim 11, wherein said latch member and said detachable base are constructed in a cooperative relation so as to provide a locking means for locking said latch member to said detachable base when said latch member is in its closed position.

14. The structure defined in claim 11, wherein said catch means includes a bail which is pivotally connected to said latch member and is constructed and arranged to catch the opposite adjacent structure to the structure carrying said base, and to pull the adjacent structures together in a tightly secured relation when said latch member is pivoted to its closed position.

* * * * *